US005244345A

United States Patent [19]

Curtis

[11] Patent Number: 5,244,345

[45] Date of Patent: Sep. 14, 1993

[54] ROTOR

[75] Inventor: David S. Curtis, Bristol, England

[73] Assignee: Rolls-Royce plc, London, England

[21] Appl. No.: 820,795

[22] Filed: Jan. 15, 1992

[30] Foreign Application Priority Data

Jan. 15, 1991 [GB] United Kingdom ..... 9100834

[51] Int. Cl.[5] ..... F01D 5/22

[52] U.S. Cl. ..... 416/95; 416/193 A

[58] Field of Search ..... 416/95, 96 R, 193 A, 416/219 R, 220 R, 248

[56] References Cited

U.S. PATENT DOCUMENTS

| | | | |
|---|---|---|---|
| 2,649,278 | 8/1953 | Stalker | 416/193 A |
| 3,008,689 | 11/1961 | Morley et al. | 416/193 A |
| 3,446,481 | 5/1969 | Kydd | 416/219 R |
| 3,471,127 | 10/1969 | Emmerson | 416/193 A |
| 3,761,200 | 9/1973 | Gardiner | 416/220 R |
| 4,650,399 | 3/1987 | Craig et al. | 416/248 |
| 4,802,824 | 2/1989 | Gastebois et al. | 416/193 A |

FOREIGN PATENT DOCUMENTS

| | | | |
|---|---|---|---|
| 161997 | 1/1954 | Australia | 416/95 |
| 429353 | 5/1991 | European Pat. Off. | 416/220 R |
| 989556 | 9/1951 | France | 416/193 A |
| 811921 | 4/1959 | United Kingdom | 416/193 A |
| 811922 | 4/1959 | United Kingdom | 416/219 R |
| 1394739 | 5/1975 | United Kingdom | 416/193 A |
| 2006883 | 5/1979 | United Kingdom | 416/193 A |
| 2186639 | 8/1987 | United Kingdom | 416/193 A |

*Primary Examiner*—Edward K. Look
*Assistant Examiner*—James A. Larson
*Attorney, Agent, or Firm*—Oliff & Berridge

[57] ABSTRACT

A rotor having a bladed disc and for use in a fluid flow machine has plates extending between and supported by the blades to protect the disc rim from erosion and foreign object damage and also, when the rotor is a gas turbine, to protect the disc rim from the heating effects of high temperature gasses. The plates are held between ridges on the blade faces.

10 Claims, 2 Drawing Sheets

ROTOR

FIELD OF THE INVENTION

This invention relates to a rotor for use in a fluid flow machine and particularly for use in a gas turbine engine.

BACKGROUND OF THE INVENTION

In fluid flow machines bladed rotors comprising a rotor disc bearing aerofoil blades around its rim are commonly used. Such rotors are vulnerable to damage to the rotor disc rim causing blades to break off of the disc or the disc itself to break up. Such damage can be caused by erosion by the fluid flow itself or impact damage by solid foreign objects carried in the fluid flow.

These problems are particularly pronounced in the turbine and compressor rotors in gas turbine engines because of the very high rates of rotation involved. As a result centrifugal loads are very large and failure of the rotor disc or blade loss can be catastrophic because of the high kinetic energy of the released blade or disc fragments.

In addition these high rates of rotation and the generally high gas flow velocities within the engine make the chances of erosion or foreign object damage more likely than in rotors subjected to less extreme conditions, this is particularly true of turbine rotors which operate at high temperatures in a very high temperature gas flow.

The very high temperature of the gas flow can also indirectly cause damage to the disc due to the stresses produced by differential thermal expansion, because the disc rim will be heated by the gas flow to a much higher temperature than the main bulk of the disc.

One known method of protecting the rotor rim from these problems is to coat it with a layer of material less susceptible to damage than the basic rotor material and having a low thermal conductivity. The choice of rotor material generally cannot be made based on damage resistance and capacity to endure temperature differentials alone but must be a trade off between these and other properties such as strength and density, but the use of a coating to protect the disc from impact and insulate it to reduce temperature differences allows the disc material to be selected based only on these other properties.

The use of such a coating has two main drawbacks, firstly the problem of ensuring that the coating does not separate from the disc under centrifugal and differential thermal expansion loads and secondly, if a blade is damaged it will be more difficult to remove and replace it because this will generally require that at least part of the coating also be removed and replaced, a demanding operation.

This invention was intended to provide a rotor at least partially overcoming these problems.

SUMMARY OF THE INVENTION

This invention provides a rotor for use in a fluid flow machine, the rotor comprising a disc bearing a plurality of blades at its outermost rim and having a plurality of plates each extending between adjacent blades, the numbers of plates and blades being equal and the plates forming a substantially continuous barrier around the disc.

The plates form a protective barrier preventing erosion or foreign object damage to the disc, as a result the disc material can be selected purely on strength and other criteria ignoring erosion and damage resistance. The plates can easily be secured so as to accommodate thermal expansion and being separate from the blades and disc can easily be removed and replaced to allow blade replacement.

The plates also form a barrier preventing exposure of the disc to the fluid flow, where the fluid is at a high temperature the plates act as a thermal barrier and so reduce the temperature differentials within the disc.

BRIEF DESCRIPTION OF THE DRAWINGS

A rotor employing the invention will now be described by way of example only with reference to the accompanying diagrammatic figures in which.

DETAILED DESCRIPTION OF PREFERRED EMBODIMENTS

Figure 1:
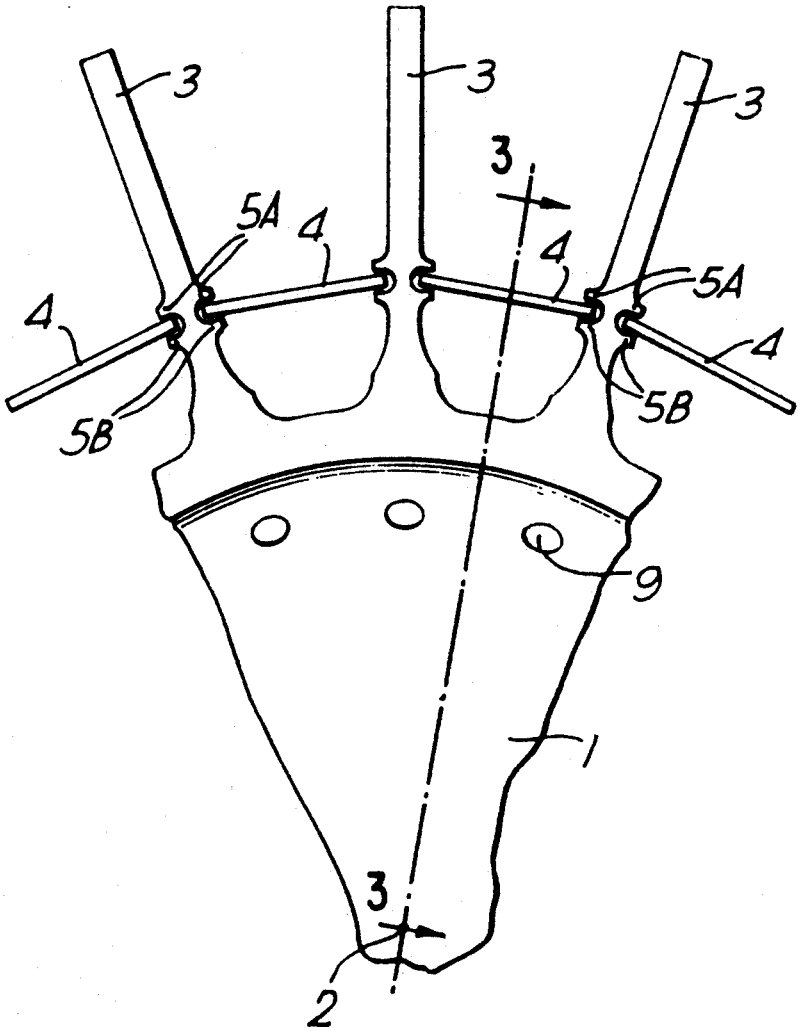
FIG. 1 shows an axial view of a portion of a rotor.

Referring to the figures a gas turbine rotor for use in a gas turbine engine is formed by a disc 1 having an axis of rotation 2 and bearing a plurality of blades 3 at its rim. The blades 3 are conventional being aerofoils in cross section and having upstream and downstream edges and suction and pressure surfaces and are evenly spaced around the circumference of the disc 1. The blades 3 are formed separately from the disc 1 and then attached by linear friction bonding to provide an integral bladed turbine disc or blisk.

Each blade 3 has a first and a second ridge 5A on its pressure and suction surfaces respectively, each extending from the upstream edge to the downstream edge of the blade 3. All of the ridges 5A are at the same distance along the blades 3 from the disc 1, so they are all at the same radius relative to the axis 2.

Each blade 3 also has a pair of ridges 5B and 5C on its pressure surface and on its suction surface, the ridge 5B being towards the leading edge of the blade 3 and the ridge 5C being towards its trailing edge. The ridges 5B and 5C are parallel to and spaced apart from the ridges 5A. All of the ridges 5B and 5C are at the same distance along the blades 3 from the disc 1 and they are all at the same radius relative to the axis 2.

The ridges 5A are at a greater radius relative to the axis 2 than the ridges 5B and 5C.

A plurality of plates 4 are held between the blades 3. Each plate 4 extends between two adjacent blades 3 and the edges of the plates 4 lie between the ridges 5A and the ridges 5B and 5C on each of the adjacent blades 3. the ridges 5A, 5B and 5C hold the plates 4 in place between them, preventing them from moving radially inward or outward. The plates 4 can however be moved axially, sliding between the ridges 5A, 5B and 5C, this allows removal and replacement of the plates 4. The plates 4 form an annular substantially continuous protective barrier surrounding and spaced apart from the disc 1. The barrier formed by the plates is broken by the blades 3 where they pass between the plates 4, however the barrier is still substantially continuous because the blades 3 are effectively a part of the barrier at these points.

The plates 4 are able to move slightly circumferentially because they are slightly smaller than the distance between the blades 3, the ridges 5A, 5B and 5C project far enough from the faces of the blades 3 to ensure that the plates 4 cannot come out radially. This slight movement allows any movement due to differential thermal expansions to be taken up without producing damaging strains in the rotor.

In use the main radial loads on the plates 4 will be centrifugal loads acting radially outwards, the only load acting radially inward will be gravity and this will be completely outweighed by the centrifugal loads except then the turbine is not operating and for a very short period on starting and shutting down the engine. The radially outward loads will be much larger than the radially inward loads, so although continuous ridges 5A are needed to support the radially outward loads only partial ridges 5B and 5C are needed to support the radially inward loads.

The gas flow to the turbine is delivered through an annular gas duct coaxial with the disc 1 and with an inner boundary at the radial position of the plates 4, this causes the gas flow to pass outside of the plates 4.

The plates 4 prevent the gas flow coming into contact with the rim of the disc 1 and thus protect the disc 1 from erosion or foreign object damage and reduce heat flow from the gas flow to the disc 1. As a result only the portion of the blades 3 lying radially outside of the plates 4 interact aerodynamically with the gas flow.

Each blade 3 contains a first set of six cooling air channels 6 which inject cooling air between the plate 4 and the rim of the disc 1. This cools the plate 4 and produces a layer of cool air between the plate 4 and the disc 1, reducing heat transfer between them.

Each blade 3 also contains a second set of three cooling air channels 7 arranged so that cooling air passes in turn through all three of the cooling air channels 7 and then exhausts through a number of cooling air passages 8 at the training edge of the blade 3 into the gas flow through the turbine. Internal cooling air systems of this kind are well known in turbine blades and need not be described further here.

Both sets of cooling air channels 6 and 7 are fed with cooling air through passages 9 within the disc 1. The passages 9 open out on the faces of the disc 1 within the disc live rim. The disc live rim is the largest radius where the disc 1 forms a continuous circle and is denoted by the dotted line 10.

Cooling air can be contained adjacent the faces of the disc 1 by sealing structures between the disc 1 and the non-rotating parts of the turbine (not shown), such seals are commonly used in the art and need not be described herein, this cooling air can then be directed into the cooling air passages 9.

Since the cooling air passages 9 open out within the disc live rim it is not necessary to provide a seal between non-rotating turbine parts and the disc 1 outside the disc live rim, which simplifies seal construction.

Figure 3:
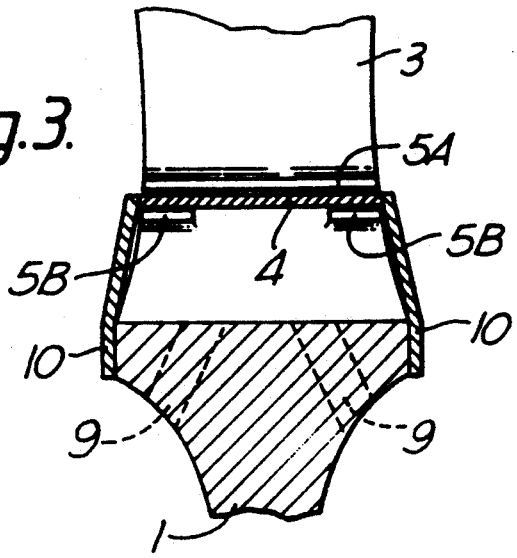
FIG. 3 shows a cut away view along the line A—A in FIG. 1, identical parts having the same reference numerals throughout.
Figure 2:
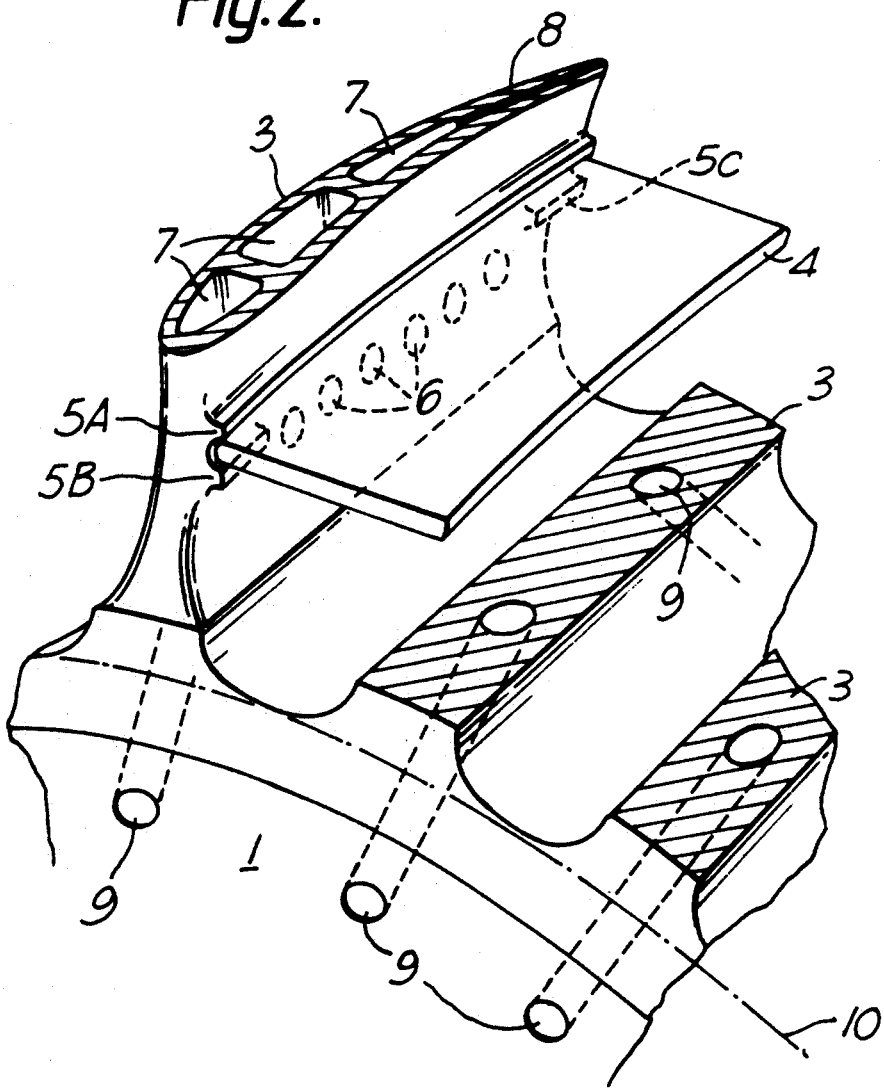
FIG. 2 shows a cut away perspective view of the rotor of FIG. 1.

The plates 4 are prevented from moving axially by a pair of annular lockplates 10, shown in FIG. 3 only. Each lockplate 10 is an annulus coaxial with the disc 1 and cooperates with projections on a face of the disc 1 to form a bayonet joint securing the lockplate 10 to the disc 1. Bayonet joints are well known and need not be described in detail herein. The outer rim of each lockplate 10 bears against the ends of the plates 4 and the edges of the blades 3 and so prevents the plates 4 from moving axially. The lockplates 10 slow the escape of cooling air from the spaces defined between the disc 1, blades 3 and plates 4, but no seal is formed between the plates 4 and the lockplate 10. This allows cooling air injected between the plates 4 and the disc 1 by the cooling air channels 6 to escape, thus allowing circulation of this cooling air.

The lockplates 10 can be removed simply by rotating them relative to the disc 1 to undo the bayonet joint, the plates 4 can then be slid out axially from between the blades 3. Thus damaged plates 4 can be easily replaced, and plates 4 can be easily removed and replaced to allow replacement of damaged blades 3.

The invention can be applied to a compressor rotor as well as to the turbine rotor described.

It is not essential to the invention that the blades or the spaces between the plates and disc rim be cooled, even if no cooling is provided the plates will still protect the disc from damage.

If the blades and plates are cooled other cooling air routes than those described could be used. For example cooling air could be introduced into the space between the plate and the disc by passing it between the lockplate and the disc face, the air could then enter the blades via the cooling air channels 6. The number of cooling air channels can of course be varied depending on cooling air requirements.

The lockplates could be replaced by other axial fixing structures, such as projections integral with the blades or disc or the use of pins.

It is not essential for the ridges 5A to be continuous, partial ridges could be used provided they were able to support the loads on the plates, similarly the ridges 5B and 5C could be replaced by a continuous ridge or three or more partial ridges. The ridges 5A shown are at a constant radius from the axis 2, such that they all lie on the surface of a cylinder, instead this radius could vary along the length of each ridge 5A so that they lie on the surface of a cone. Similarly the ridges 5B and 5C could also lie on the surface of a cone, the ridges 5B and 5C being parallel to the ridges 5A to allow removal and replacement of the plates.

Also the plates could be secured by their edges fitting into grooves in the surfaces of the blades, but the use of ridges is preferred because grooves would weaken the blades.

The described example is a blisk formed by attaching blades to the disc using linear friction bonding, the invention is equally applicable to blisks formed in other ways such as welding, diffusion bonding or machining the disc and blades from a single metal block or to rotors employing discrete blades and discs.

I claim:

1. A rotor for use in a fluid flow machine, the rotor comprising:

a disc bearing a plurality of blades at its outermost rim; and a plurality of axially removable plates extending between adjacent blades, the number of plates and blades being equal, wherein the plates form a substantially continuous barrier around the disc and cooperate with structures on the blades to prevent outward and inward radial movement of the plates relative to the disc.

2. A rotor as claimed in claim 1 in which a space is defined between each plate and the disc.

3. A rotor as claimed in claim 2 in which cooling air is injected into the space defined between each plate and the disc.

4. A rotor as claimed in claim 1 in which the structures are radially spaced apart ridges on the blade faces and the edges of the plates fit between the ridges.

5. A rotor as claimed in claim 1 in which the plates are prevented from moving axially relative to the disc by lockplates secured to the disc.

6. A rotor as claimed in claim 1 in which the plates prevent the fluid flow past the rotor from impinging on the disc rim.

7. A rotor for use in a fluid flow machine, the rotor comprising:

a disc bearing a plurality of radially extending blades at its outermost rim; and a plurality of axially removable plates extending between adjacent blades, the number of plates and blades being equal and the plates forming a substantially continuous circumferential barrier around the disc to prevent fluid flow through the rotor from impinging on the disc, wherein each blade is provided with radially spaced ridges on each blade face, the ridges being structured so that the plates are radially retained solely by the ridges, thereby preventing radial movement of the plates relative to the disc.

8. The rotor as claimed in claim 7 wherein edges of the plates are located between the ridges.

9. A rotor as claimed in claim 7 wherein a space is defined between each plate and the disc.

10. A rotor as claimed in claim 7 wherein the plates are prevented from moving axially relative to the disc by lockplates secured to the disc.

* * * * *